US005669827A

United States Patent [19]

Nagamoto

[11] Patent Number: 5,669,827

[45] Date of Patent: Sep. 23, 1997

[54] METALLIC WOOD CLUB HEAD FOR GOLF

[75] Inventor: Itsushi Nagamoto, Hamamatsu, Japan

[73] Assignee: Yamaha Corporation, Japan

[21] Appl. No.: 607,771

[22] Filed: Feb. 27, 1996

[30] Foreign Application Priority Data

Feb. 27, 1996 [JP] Japan ..... 7-061517

[51] Int. Cl.[6] ..... A63B 53/04

[52] U.S. Cl. ..... 473/345; 473/349

[58] Field of Search ..... 473/324, 345, 473/332, 342, 347, 350, 346, 349, 334

[56] References Cited

U.S. PATENT DOCUMENTS 4,438,931 3/1984 Motomiya .
5,242,168 9/1993 Aizawa .
5,288,070 2/1994 Chen .
5,316,298 5/1994 Hutin .
5,328,176 7/1994 Lo .
5,377,986 1/1995 Viollaz .

*Primary Examiner*—Sebastiano Passaniti
*Attorney, Agent, or Firm*—Ostrolenk, Faber , Gerb & Soffen, LLP

[57] ABSTRACT

In construction of a metallic wood golf club head having a shell structure made up of a plurality of shell pieces united together, at least one shell piece is at least locally provided with a laminated construction which includes laminated and intermediate layers made of different materials. Changes in combination of materials and allocation of laminated construction allows free adjustment In weight distribution, thereby achieving high ball shooting characteristics and maneuverability at swing. Fortification of the face is made compatible with enlargement in size of a club head.

5 Claims, 2 Drawing Sheets

METALLIC WOOD CLUB HEAD FOR GOLF

BACKGROUND OF THE INVENTION

The present invention relates to a metallic wood club head for golf, and more particularly relates to improvement in freedom of design of weight distribution of a wood golf club head having a metallic shell for better ball shooting characteristics and maneuverability at swing.

Metallic club heads are now most prevalent in the field of wood club heads, and are roughly classified into an iron group, a titanium group and an aluminum group. Stainless steel (SUS) is mainly used for the iron group whereas titanium alloys are mainly used for the titanium group. As well known, these metals are significantly different in specific gravity. That is, the specific gravity of stainless steel in general is much higher than that of titanium in general. Because of such a difference in specific gravity, stainless steel club heads are generally regarded as "compact club heads " and titanium club heads as "large club heads ". Despite such a basic classification, there are increasing demands for large club heads made of stainless steel too. In some examples, stainless club heads of volumes larger than 200 cc are noted in the market.

In order to maintain good maneuverability, such enlargement in size of a club head needs to be achieved within the limit of unchanged total weight. Stated otherwise, the wall thickness of a shell structure has to be reduced in order to enlarge the size of a club head without increase in total weight.

Nevertheless, it is not allowed to reduce the wall thickness at the face and neck of a club head which are highly required to well withstand impulsive mechanical shocks at shooting balls. Thus, significant fractions of the total weight have to be allocated to these sections of the club head and only little fractions can be allocated to the rear sections of the club head. As a consequence, the center of gravity of the club head is located near the face of the club head. As is well known, such a location of the center of gravity does not allow easy back-spin performance and launch angle of balls is accordingly very low.

In the case of the titanium and aluminum groups, their relatively low specific gravities enables free enlargement in size without significant reduction in wall thickness of a shell structure even within the limit of unchanged total weight. Stated otherwise, an appreciable fraction of the total weight can be allocated to the rear sections of a club head even leaving sufficient wall thickness to the face and the neck. Freedom in design of weight distribution is larger than the case of stainless steel club heads. Nevertheless, freedom in design of weight distribution is still highly limited even in the case of titanium or aluminum club heads because of the construction of their shell structure.

In the construction of a typical shell structure, the shell structure is made up of several shell pieces united together. For example, the shell structure is made up of a face shell piece, a top shell piece, a bottom shell piece, top and heel shell pieces and a rear shell piece. The shell pieces may be different in wall thickness depending on the functions demanded. The shell pieces are prepared by, for example, forging and shaped shell pieces are united together by, for example, welding.

For adjustment of weight distribution, foam resin is foam resin is infused into the cavity defined by the shell structure or one or more balancing element are welded to the interior of the shell structure. In the former case, the foam resin is fully infused into the cavity and, as a result, freedom in weight distribution is much limited. In the later case, the balancing elements are made of a similar material to the shell structure. So, the freedom in weight distribution is also more or less limited. Further in either case, infusion or welding needs to be carried out in addition to the intrinsic formation of the shell structure.

SUMMARY OF THE INVENTION

It is the basic object of the present invention to enhance freedom in design of weight distribution in a metallic wood club head whilst maintaining its good ball shooting characteristics and maneuverability at swing.

It is another object of the present invention to enable free adjustment of weight distribution in a metallic wood club head without any substantial increase in operation steps subsequent to intrinsic formation of the shell structure.

In accordance with the basic aspect of the present invention, a metallic wood club head for golf comprises a metallic shell structure made up of a plurality of shell pieces united together. At least one shell piece includes, at least locally, a plurality of laminated layers made of the first material and at least one intermediate layer made of the second material.

In one preferred embodiment of the present invention, at least one shell piece includes a plurality of laminated layers made of the first material and at least one intermediate layer made of the second material.

In another preferred embodiment of the present invention, the shell structure includes, at lest locally, a plurality of laminated layers made of the first material and at least one intermediate layer made of the second material.

DETAILED DESCRIPTION OF THE PREFERRED EMBODIMENTS

Figure 1:
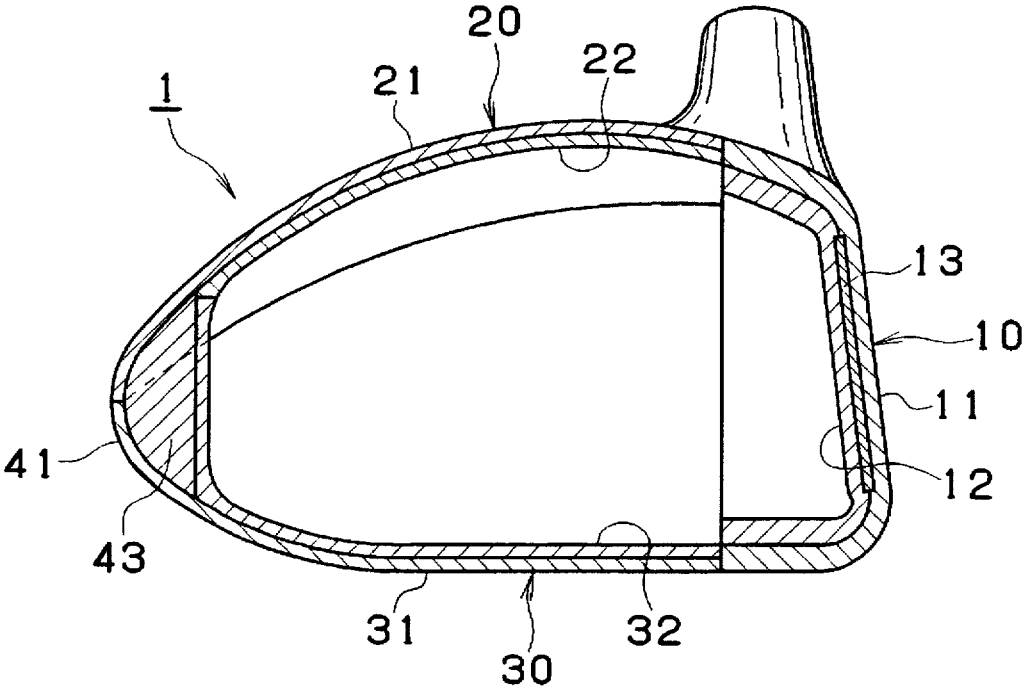
FIG. 1 is a transverse cross sectional view of one embodiment of the metallic wood club head in accordance with the present invention.

The first embodiment of the wood club head in accordance with the present invention is shown in FIG. 1, in which a shell structure 1 is made up of three shell pieces of different laminated constructions. More specifically, the shell structure 1 is made up of three shell pieces 10, 20 and 30 united together in a known manner. The first shell piece 10 spans the face of the club head and includes an outer layer 11, an inner layer 12 and an intermediate layer 13. The second shell piece 20 spans the top of the club head and includes an outer layer 21 and an inner layer 22. The third shell piece 30 spans the bottom, rear, toe, heel and rear of the club head. At the bottom, the third shell piece 30 includes an outer layer 31 and an inner layer 32. Whereas at the rear, the third shell piece 30 includes an outer layer 41, an inner layer 42 and an intermediate layer 43.

The shell structure 1 is generally made of titanium, stainless steel or aluminum. The intermediate layer 13 in the first shell piece 10 is made of a metallic material different from that for the outer and inner layers 11, 12. Mechanical strength and/or the rigidity of the metallic material for the intermediate is chosen for fortification of the face and/or betterment in feel and sound at shooting balls. The rear intermediate layer 43 in the third shell piece 30 is made up of a material of high specific gravity chosen from copper or iron group. This intermediate layer 43 is added for adjustment of weight distribution. More specifically, presence of such a balancing element of high specific gravity displaces the center of gravity toward the rear off the face of the club head. Inner allocation of the additional mass enables easy back-spin performance and, as a result, increases launch angle of balls shot by the club head.

By proper choice of the materials, sizes and locations of the intermediate layers, in particular in combination with those of the outer and inner layers, the mechanical strength of the face, maneuverability at swing, feel and sound at shooting balls can be as freely designed as wanted.

Figure 2:
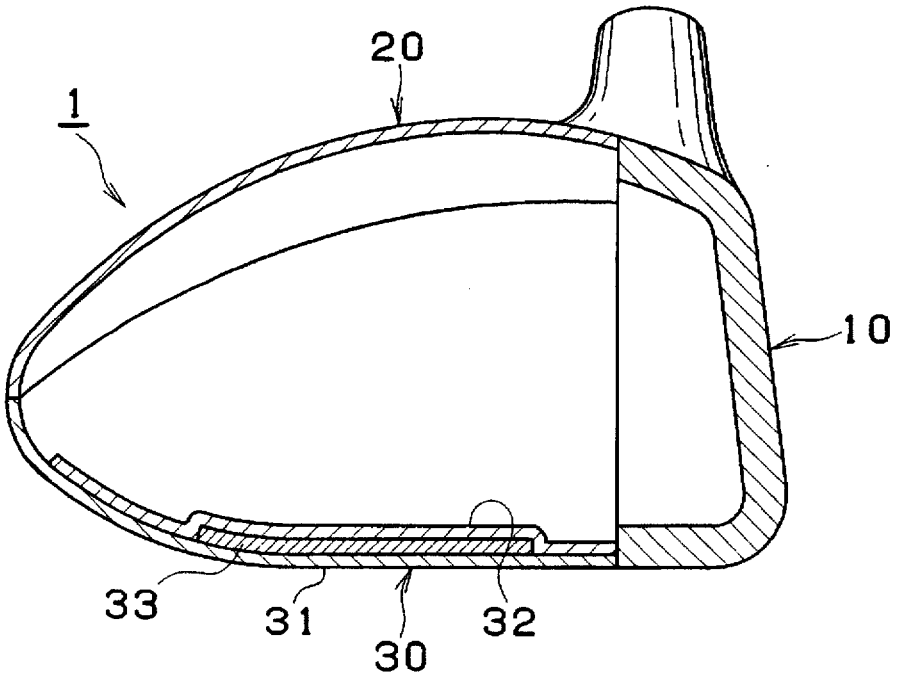
FIG. 2 is a transverse cross sectional view of another embodiment of the metallic wood club head in accordance with the present invention.

The second embodiment of the wood club head in accordance with the present invention is shown in FIG. 2, in which its shell structure 1 is again made up of three shell pieces 10, 20 and 30 united together. The first shell piece 10 covers the face, the second shell piece 20 covers the top and the third shell piece 30 covers remaining sections of the club head, respectively. Among the three shell pieces, only the third shell piece 30 has a laminated construction at the bottom of the club head. Namely in the area of the bottom, the third shell piece 30 includes an outer layer 31, an inner layer 32 and an intermediate layer 33. The intermediate layer 33 is made of high specific gravity chosen from copper or iron group. In the case of this embodiment, the intermediate layer 33 acts as a balancing element to displace the center of gravity of the club head toward the rear off the face. Inner allocation of the additional mass assures reliable back-spin performance and, as a result, increases launch angle of balls shot by the club head.

Figure 3:
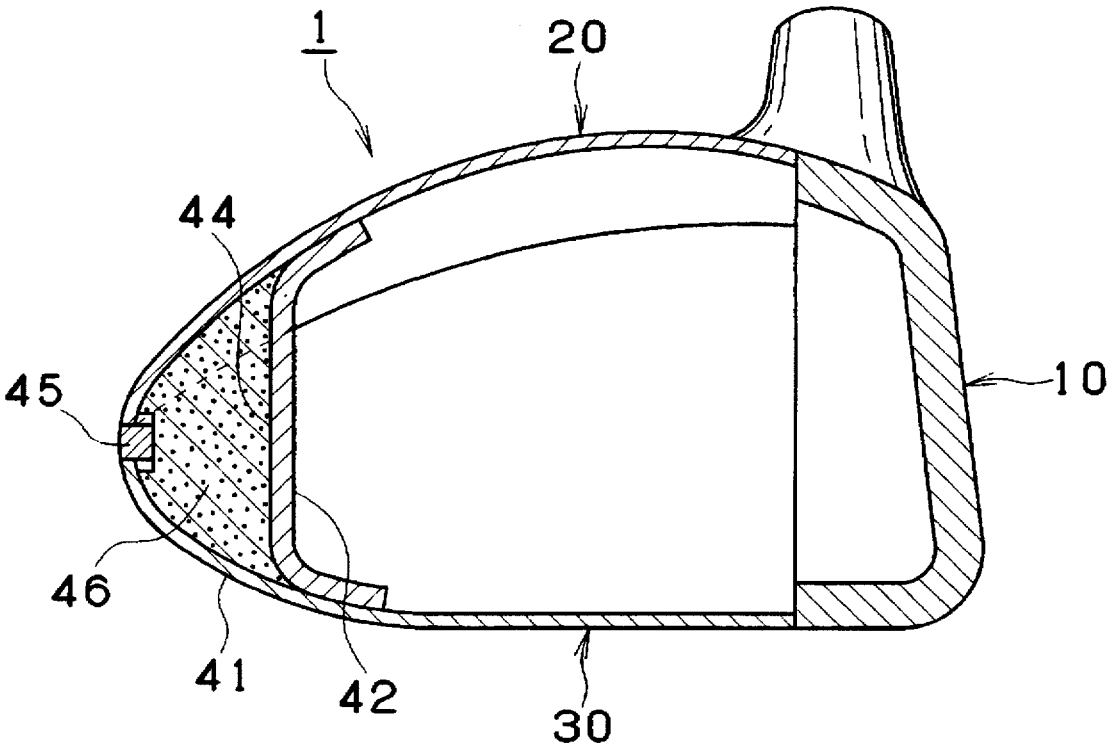
FIG. 3 is a transverse cross sectional view of the other embodiment of the metallic wood club head in accordance with the present invention.

The third embodiment of the wood club head in accordance with the present invention is shown in FIG. 3, in which its shell structure 1 is again made up of three shell pieces 10, 20 and 30 united together. The first shell piece 10 spans the face, the second shell piece 20 spans the top and the third shell piece 30 spans remaining sections of the club head, respectively. Among the three shell pieces, only the third shell piece 30 has a laminated construction at the rear of the club head. That is, in the area of the rear, the third shell piece 30 includes an outer layer 41 and an inner layer 42 leaving a space 44 in between. A mouth 45 communicating to the space 44 is formed through the outer layer 41 for infusion of a balancing element 46. The balancing element 46 is made of a low fusible metallic material such as low melting point alloy, lead, a mixture of resin with powdery lead or tungsten powder. Presence of the balancing element influences weight distribution in the club head to displace the center of gravity toward the rear of the face of the club head.

In accordance with the present invention, weight distribution in a wood club head can be designed quite freely through adjustment in laminated construction of its shell structure in order to improve ball shooting characteristics and/or maneuverability at swing. In particular, use of a material for intermediate layers different from other layers significantly broadens the frame of weight distribution adjustment. Enlargement in size of a club head under a limited weight is compatible with sufficient fortification at the face thanks to the tactful formation of the laminated shell structure.

The laminated construction of the shell structure may span locally from one shell piece to an adjacent shell piece.

I claim:

1. A metallic wood club head for golf comprising a metallic shell structure made up of a plurality of shell pieces united together, at least one of said shell pieces including, at least locally, a plurality of laminated layers made up of a first material and at least one intermediate layer made up of a second material having a specific gravity different from said first material to thereby position the center of gravity of said shell structure toward the location of said laminated layers.

2. A metallic wood club head as claimed in claim 1 in which said at least one shell piece is made up of said laminated layers and said intermediate layers.

3. A metallic wood club head as claimed in claim 1 in which said intermediate layer is present at least in a face of said club head to position the center of gravity of said shell structure toward said face.

4. A metallic wood club head as claimed in claim 1 in which said intermediate layer is present at least in a bottom of said club head to position the center of gravity of said shell structure toward said bottom.

5. A metallic wood club head as claimed in claim 1 in which said intermediate layer is present at least in a rear of said club head to position the center of gravity of said shell structure toward said rear.

* * * * *